US008424593B2

(12) United States Patent
Sauerborn et al.

(10) Patent No.: US 8,424,593 B2
(45) Date of Patent: Apr. 23, 2013

(54) PRESSURIZED-GAS COOLER FOR A COMPRESSOR

(75) Inventors: Markus Sauerborn, Bonn (DE); Stefan Bosen, Cologne (DE)

(73) Assignee: Atlas Copco Energas GmbH, Cologne (DE)

( * ) Notice: Subject to any disclaimer, the term of this patent is extended or adjusted under 35 U.S.C. 154(b) by 490 days.

(21) Appl. No.: 12/828,458

(22) Filed: Jul. 1, 2010

(65) Prior Publication Data

US 2011/0048686 A1 Mar. 3, 2011

(30) Foreign Application Priority Data

Sep. 2, 2009 (DE) ..... 10 2009 039 751

(51) Int. Cl.
*F28D 7/10* (2006.01)
*F28F 9/02* (2006.01)

(52) U.S. Cl.
USPC ..... 165/157; 165/145

(58) Field of Classification Search ..... 165/145, 165/157, 158, 159, 161, 162
See application file for complete search history.

(56) References Cited

U.S. PATENT DOCUMENTS

| | | | | | |
|---|---|---|---|---|---|
| 1,617,119 | A | * | 2/1927 | Jones | 165/82 |
| 1,655,086 | A | * | 1/1928 | Blanding | 165/163 |
| 1,841,361 | A | * | 1/1932 | Bulkeley | 165/74 |
| 2,036,957 | A | * | 4/1936 | Price | 165/81 |
| 2,519,084 | A | * | 8/1950 | Tull | 165/158 |
| 3,042,379 | A | * | 7/1962 | Hinde | 165/162 |
| 3,483,920 | A | * | 12/1969 | Kletch Jr. et al. | 165/165 |
| 5,213,156 | A | * | 5/1993 | Eriksson | 165/163 |
| 2011/0048686 | A1 | | 3/2011 | Sauerborn et al. | |

* cited by examiner

*Primary Examiner* — Tho V Duong
(74) *Attorney, Agent, or Firm* — Andrew Wilford

(57) ABSTRACT

A pressurized-gas cooler has a housing having a cylindrical side wall centered on an axis, an axially open outer end, and an axially closed inner end. A cover fitted to and closing the open outer end carries a bundle of tubes inside the housing between the housing ends. The tubes all extending parallel to one another at an angle of between 2° and 10° to a diametral plane including the housing axis such that the bundle is closer in a direction perpendicular to the plane to the side wall of the housing at one end of the housing than at the opposite end of the housing. Pressurized-gas inlet and outlet fittings open into the housing, with at least the gas inlet fitting opening into the housing to a side of the plane where the tube bundle at the respective end of the housing is more widely spaced.

8 Claims, 3 Drawing Sheets

PRESSURIZED-GAS COOLER FOR A COMPRESSOR

FIELD OF THE INVENTION

The present invention relates to a gas cooler. More particularly this invention concerns a cooler for pressurized gas coming from and/or going to a compressor.

BACKGROUND OF THE INVENTION

A typical pressurized-gas cooler for use with a compressor has a bundle of parallel tubes through which a coolant passes and a cylindrical housing that is closed at an inner end and open at an outer end. The tube bundle is installed through the open end into the housing and the tubes are connected at the outer end to a cover that closes outer-end opening of the housing. A gas inlet and a gas outlet are mounted on the side is wall of the housing, spaced apart from one another in the longitudinal or axial direction of the housing.

The pressurized-gas cooler can be used, for example, as between stages of multi-stage compressor system to cool the compressed gas as it is compressed in steps. In terms of design, the pressurized-gas cooler is a tube-bundle heat exchanger. The cover has connections for supplying coolant and withdrawing coolant. At the inner end of the cooling tubes that faces away from the cover, a fitting deflects the coolant so that it can flow back out the same end of the housing where it entered. A flow direction of the gas being cooled is predominantly transverse to the cooling tubes of the tube bundle. Hence heat transfer between the coolant and the gas is a mixture of cross-flow, counter-flow, and concurrent flow. The gas inlet and outlet connections can be individually mounted on the side wall of the housing, and are matched to the piping connected with the compressor.

Pressurized-gas coolers having this structure have proven themselves.

OBJECTS OF THE INVENTION

It is therefore an object of the present invention to is provide an improved pressurized-gas cooler for a compressor.

Another object is the provision of such an improved pressurized-gas cooler for a compressor that overcomes the above-given disadvantages, in particular where the flow distribution and flow guidance of the gas are optimized, where heat transfer is also optimized, and where gas flow pressure loss is reduced.

SUMMARY OF THE INVENTION

A pressurized-gas cooler has according to the invention a housing having a cylindrical side wall centered on an axis, an axially open outer end, and an axially closed inner end. A cover fitted to and closing the open outer end carries a bundle of tubes inside the housing between the housing ends. The tubes all extending parallel to one another at an angle of between 2° and 10° to a diametral plane including the housing axis such that the bundle is closer in a direction perpendicular to the plane to the side wall of the housing at one end of the housing than at the opposite end of the housing. Pressurized-gas inlet and outlet fittings open into the housing, with at least the gas inlet fitting opening into the housing to a side of the plane where the tube bundle at the respective end of the housing is more widely spaced.

According to the invention at least the center axis of the gas inlet connection is transverse to and radially offset from the longitudinal axis of the housing. This axis can be parallel to the diametral plane.

The measures according to the invention, that is the tilting of the tubes to the center axis or diametral plane, result in an improved flow through and around the tube bundle, with lower pressure losses. Furthermore, higher gas speeds through the tube bundle can be implemented, so that a more compact design of the pressurized-gas cooler is possible. In total, the heat transfer behavior of the apparatus is also improved.

According to a preferred embodiment of the invention, the gas-inlet and gas-outlet connections are mounted on the housing side wall at locations that are farther away from the tube bundle, because of the angled orientation of the cooling tubes, than diametrally opposite housing locations. The center axes of the two connections are transverse to but radially offset from the longitudinal axis of the housing. The angled orientation of the tube bundle creates a greater clear space both in the inflow region of the gas and in the outflow region. Because the center axis of the connections is oriented transverse to the longitudinal axis of the housing, with a radial offset, so that rotational flow of the gas that flows through the housing is is produced.

The cover preferably has an end plate that can be attached to the side wall of the housing, having an inlet for coolant and a coolant outlet, as well as a fluid space divided into compartments. In this connection, it is practical if the end plate and the fluid space form a unit configured as an integral welded construction to which the outer tube end fitting is releasably attached. The tube bundle with the cover connected with it form an interchangeable insert of the pressurized-gas cooler, which can be removed for cleaning purposes, for example. The housing and the replaceable tube bundle can be individually adapted to compressors of a compressor series that have different sizes. In this connection, the work angle that relates to the angled orientation of the tube bundle can also be corrected and optimized, while maintaining both the design structure of the housing side wall and that of the tube bundle.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
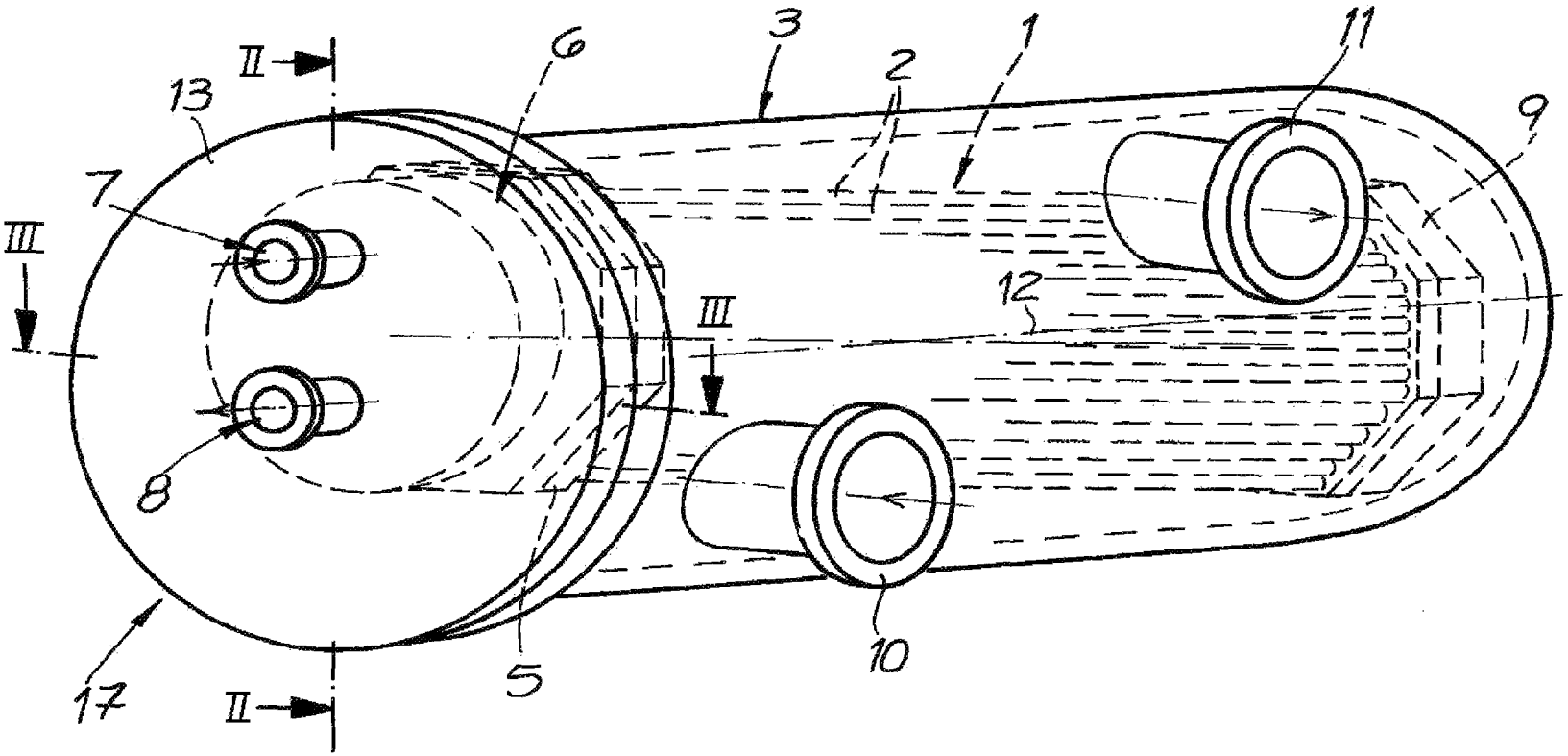
FIG. 1 is a perspective view of the cooler according to the invention.

As seen in the drawing a pressurized-gas cooler of the tube-bundle heat-exchanger type has a tube bundle 1 comprised of parallel cooling tubes 2 through which a coolant is circulated and a cylindrical housing 3 that is centered on an axis 12, closed at one end and forming at its opposite end an opening 4 for installation of the tube bundle 1. The cooling tubes 2 are all connected at their outer ends with a fitting 5 of a cover 6 that in turn fits over and closes the opening 4 of the housing 3. The cover 6 carries an inlet 7 and an outlet 8 for the coolant. A flow deflector 9 of standard design is provided at inner ends of the cooling tubes 2 away from the cover 6 so that flow takes place inward from the cover 6 in half of the cooling tubes 2 in one flow direction and outward toward the cover 6 in the other half of the tubes 2 in the opposite flow direction. A gas inlet connection 10 and outlet connection 11 for a gas to be cooled open tangentially into the housing 2 at axially offset locations but parallel to each other and symmetrically flanking a diametral plane II-II that the inlet 7 and outlet 8 also diametrally flank.

Figure 2:
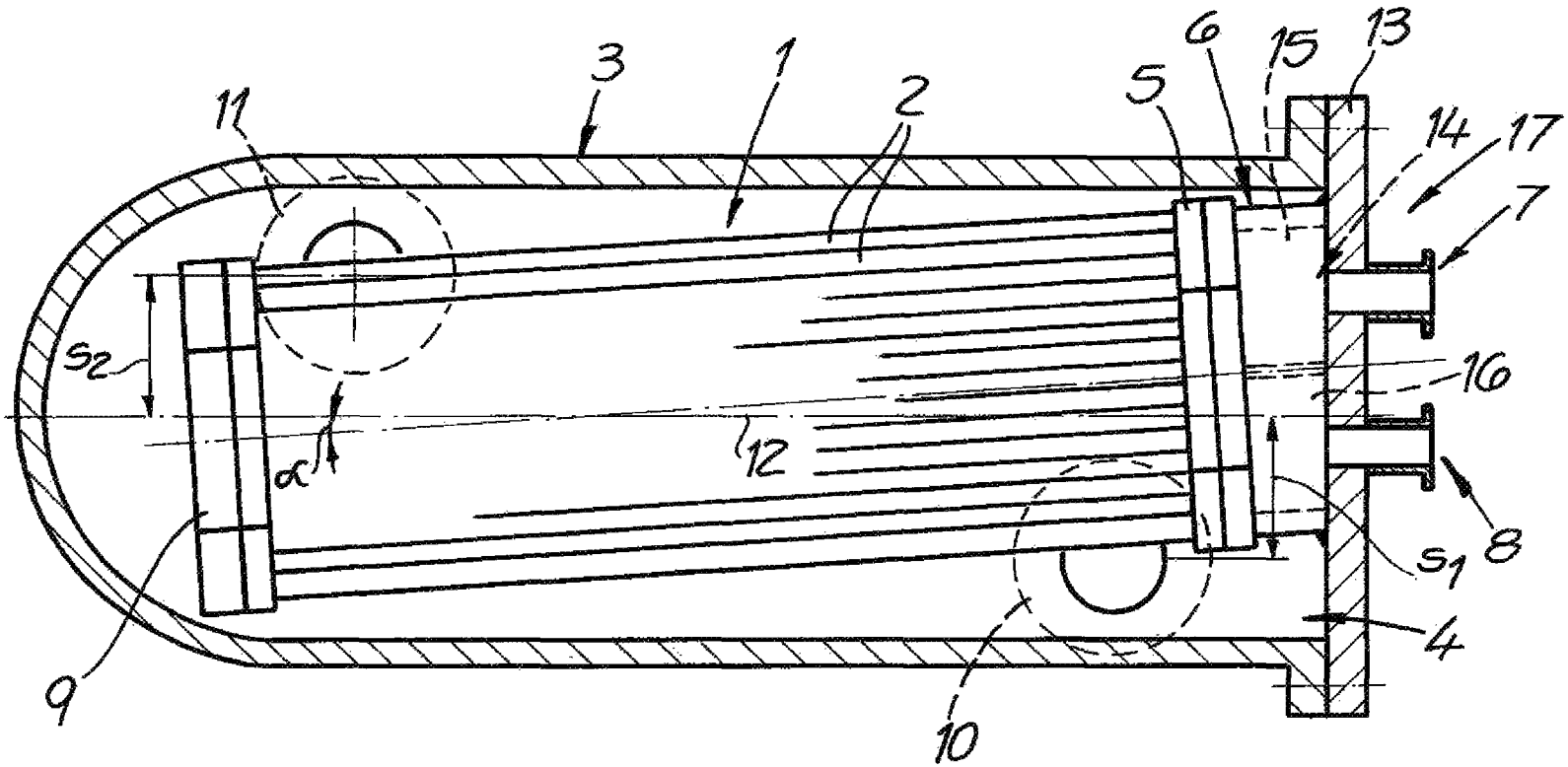
FIGS. 2 and 3 are sections taken respectively along first and second diametral planes shown at II-II and III-III in FIG. 1.
Figure 3:
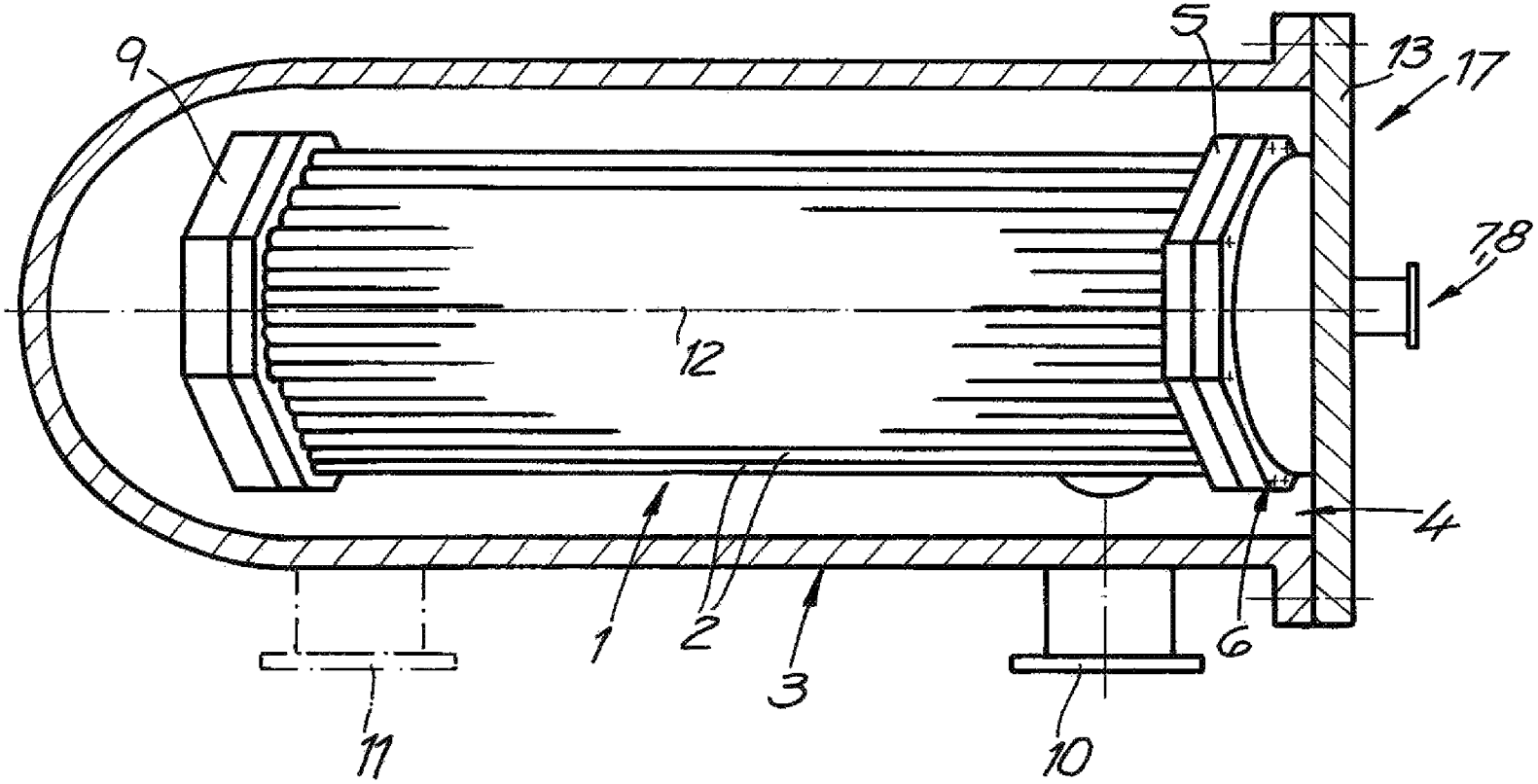

It is particularly evident from the sectional view of FIG. 2 that the cooling tubes 2 of the tube bundle 1 are oriented at a small acute angle $\alpha$ of 2° to 10° to the diametral plane II-II including the longitudinal axis 12 of the cylindrical housing 3. Furthermore, FIGS. 1 and 2 show how the two inlet and outlet connections 10 and 11 for gas are on the housing 2 in locations that are farther away from the tube bundle 1, as a result of the angled orientation of the cooling tubes 2, than the diametrally opposite housing regions and that the center axes of these connections 10, 11 are offset outward from the diametral plane II-II and longitudinal axis 12 of the housing 3 by respective radial offsets $s_1$, $s_2$. Thus the spacing between the bundle 1 of tubes 2 and the side wall of the housing 3 is greater at the locations where the connections 10 and 11 open into the housing 3.

The cover 6 has an end plate 13 that can be attached to a rim of a side wall of the housing 3 and carries the coolant inlet 7 and outlet 8. This cover 6 also has a body 14 that forms a pair of compartments 15 and 16 into each of which the outer ends of a respective half of the tubes 2 opens. The end plate 13 and body 14 are welded together into an integral unit 17 to which the tube fitting 5 is releasably attached.

As a result of the angled orientation of the tube bundle 1 inside the housing 3 according to the invention, particularly in combination with the arrangement of the gas-inlet and -outlet connections 10 and 11 as described, the flow distribution and the flow path of the gas through the tube bundle 1 can be improved. In comparison with a pressurized-gas cooler having the same structure and the same size, whose tube bundle 1 is aligned parallel to and centered on the longitudinal axis of the housing, higher gas speeds can be used with the same flow is pressure loss. In total, the heat transfer behavior can be improved.

We claim:

1. A pressurized-gas cooler comprising:

a housing having a cylindrical side wall centered on an axis, an axially open outer end, and an axially closed inner end;

a cover fitted to and closing the open outer end;

a bundle of tubes carried on the cover inside the housing between the housing ends, the tubes all extending parallel to one another at an angle of between 2° and 10° to a diametral plane including the housing axis such that the bundle is closer in a direction perpendicular to the plane to the side wall of the housing at one end of the housing than at the opposite end of the housing; and pressurized-gas inlet and outlet fittings opening into the housing, at least the gas inlet fitting opening into the housing to a side of the plane where the tube bundle at the respective end of the housing is more widely spaced from the side wall.

2. The pressurized-gas cooler defined in claim 1 wherein the inlet fitting has a center axis spaced radially from the diametral plane.

3. The pressurized-gas cooler defined in claim 1 wherein the gas outlet fitting opens into the housing to a respective side of the plane where the tube bundle at the respective end of the housing is more widely spaced from the side wall, the inlet and outlet fittings flanking the diametral plane.

4. The pressurized-gas cooler defined in claim 3 wherein the gas inlet and gas outlet both open tangentially into the housing generally parallel to the plane.

5. The pressurized-gas cooler defined in claim 1 wherein the cover is provided with a coolant inlet and a coolant outlet and compartments for distributing the coolant from the coolant inlet and outlet to the outer ends of the tubes.

6. The pressurized-gas cooler defined in claim 5 wherein the cover includes an end plate and a body forming the compartments and integrally connected to the end plate.

7. The pressurized-gas cooler defined in claim 1 wherein the gas inlet fitting and gas outlet fitting are spaced axially from each other.

8. The pressurized-gas cooler defined in claim 7 wherein the gas inlet fitting and gas outlet fitting symmetrically flank the diametral plane.

* * * * *